US006604467B2

(12) United States Patent
Alculumbre et al.

(10) Patent No.: US 6,604,467 B2
(45) Date of Patent: Aug. 12, 2003

(54) SAFETY SYSTEM FOR A PROJECTILE FUSE

(76) Inventors: Michael Alculumbre, 29 Tillingbourne Gardens, London N3 3JJ (GB); Frederick Sharp, No. 4 Priory Mansions, Englands Lane, London NW3 4th (GB)

( * ) Notice: Subject to any disclaimer, the term of this patent is extended or adjusted under 35 U.S.C. 154(b) by 0 days.

(21) Appl. No.: 10/254,194

(22) Filed: Sep. 25, 2002

(65) Prior Publication Data

US 2003/0024427 A1 Feb. 6, 2003

Related U.S. Application Data

(63) Continuation of application No. 09/647,615, filed as application No. PCT/GB99/01042 on Apr. 6, 1999, now abandoned.

(30) Foreign Application Priority Data

Apr. 3, 1998 (GB) ..... 9807290
Aug. 11, 1998 (GB) ..... 9817471

(51) Int. Cl.[7] ..... F42C 15/24

(52) U.S. Cl. ..... 102/249; 102/221; 102/236; 102/247; 102/222

(58) Field of Search ..... 102/236, 247, 102/249, 242, 376, 221, 231, 259, 351

(56) References Cited

U.S. PATENT DOCUMENTS

| | | | | | |
|---|---|---|---|---|---|
| 2,006,575 | A | * | 7/1935 | Methlin | 102/231 |
| 2,441,939 | A | * | 5/1948 | Nichols | 102/236 |
| 2,446,019 | A | * | 7/1948 | Nichols | 102/236 |
| 2,458,405 | A | | 1/1949 | Nichols | |
| 2,537,855 | A | | 1/1951 | Porter | |
| 2,554,586 | A | | 5/1951 | Miller | |
| 2,564,797 | A | | 8/1951 | Thompson | |
| 2,709,962 | A | * | 6/1955 | Funk, Jr. et al. | 102/249 |
| 2,845,866 | A | | 8/1958 | Jasse | |
| 3,326,128 | A | * | 6/1967 | Choate | 102/376 |
| 3,576,165 | A | * | 4/1971 | Gawlick et al. | 102/259 |
| 3,636,880 | A | * | 1/1972 | Aske | 102/236 |
| 3,961,578 | A | * | 6/1976 | Popovitch | 102/242 |
| 3,968,945 | A | * | 7/1976 | Walton | |
| 4,406,225 | A | * | 9/1983 | Backstein et al. | 102/236 |
| 4,697,524 | A | * | 10/1987 | Penner et al. | |
| 5,189,250 | A | * | 2/1993 | Shaphyr | 102/259 |
| 6,279,480 | B1 | * | 8/2001 | Roosemann | 102/236 |

FOREIGN PATENT DOCUMENTS

| | | | | |
|---|---|---|---|---|
| CH | 79515 | | 7/1917 | |
| DE | 308558 | | 11/1917 | |
| FR | 424890 | | 5/1911 | |
| FR | 627004 | | 9/1927 | |
| FR | 863175 | | 3/1941 | |
| FR | 71906 | | 3/1960 | |
| GB | 3268 | | 6/1864 | |
| GB | 2150673 | A * | 7/1985 | 102/247 |

* cited by examiner

*Primary Examiner*—Michael J. Carone
*Assistant Examiner*—Lulit Semunegus
(74) *Attorney, Agent, or Firm*—Lawrence E. Laubscher, Jr.

(57) ABSTRACT

The invention provides a safety system for a small arms projectile in which an initiating device is impacted by a firing member in order to detonate a main explosive charge. The system requires the firing member to be retained in a safe position in relation to the initiating device by at least two independent mechanisms. The firing member is initially supported in a forward position, in which it assists in holding the initiator device in a safe condition, and is caused to move rearwardly, through inertia, when the projectile is fired, destroying one of the retaining mechanisms and allowing the initiator device to adopt a primed position in which it can be activated by the firing member which at this time is retained by the other retaining mechanism which is automatically released when the projectile is in flight. The initiator device may, when held in its safe condition, be skewed with respect to the main explosive charge and may incorporate or support a shield disposed, in the safe condition, between the initiator device and the main explosive charge.

13 Claims, 6 Drawing Sheets

1
29
31
2
32
32
41
23
26
25
30
5
8
9
4
3
6
20
10
7
21
19
17
18
13
13
16
11
12
27
27
28
28
27
27
28
15
24
28

SAFETY SYSTEM FOR A PROJECTILE FUSE

This application is a continuation of application Ser. No. 09/647,615 filed Dec. 5, 2000, now abandoned, which is a 371 of PCT/GB99/01042, filed Apr. 6, 1999.

BACKGROUND OF THE INVENTION

The present invention relates to a safety system particularly for a small arms projectile for a small arms weapon.

BRIEF DESCRIPTION OF THE PRIOR ART

In our European Patent EP-B-0363079 there is described a small arms projectile for a smooth bore weapon preferably fired from a cartridge with a propellant charge therein, wherein the projectile comprises a generally cylindrical casing, a warhead assembly, said warhead being hollow to accommodate an explosive charge and an initiator therefor, the casing being formed with a firing pin spring biased to a safety position and locked in the safety position by at least one spring biased safety pin, wherein the spring biased safety pin is adapted to release on exit of the projectile from the muzzle of the small arm weapon.

EP-B-0363079 thus describes a projectile having a mechanical safety means for retaining the firing pin in the safety position. The mechanical safety means comprises at least one spring biased safety pin extending normal to the axis of the firing pin and located in a radial bore in the firing pin to prevent axial movement of the firing pin. The safety pin is radially retained by the cartridge.

There is a drawback associated with this arrangement. When the projectile leaves the muzzle of the small arms weapon there is a severe deceleration as it hits still air and this causes the projectile casing to decelerate and a deceleration force to be applied to the firing pin in the direction of the initiator. The shear force applied to the safety pin by the deceleration between the casing and the firing pin prevents ejection of the safety pin until the shear force is overcome by the spring biassing force acting on the pin. The firing pin is thus retained in its safety position by the safety pin. Only when the shear force has reduced will the safety pin release the firing pin. The effect of this is to delay the arming of the projectile by at least 0.1 seconds (or about 10 metres), or more reliably 0.2 to 0.3 seconds, which equates generally to about 20 or 30 metres down range. This means that targets at short range cannot be engaged and even targets of 25 to 30 metres cannot always be engaged reliably.

A further drawback with this arrangement is that there is only one safety means for retaining the firing pin in the safety position. There is a possibility therefore that the explosive charge could be initiated accidentally if the safety pin became dislodged from the firing pin due to the cartridge being damaged, for example.

In order to address these problems EP-B-0363079 suggests the use of a chemical safety means in addition to the mechanical safety means. The chemical safety means includes a layer of combustible adhesive material interposed between the firing pin and an adjacent hollow portion of the casing. The combustible adhesive material is connected to a bore at the rear of the casing adjacent a propellant charge so that it is activated by the explosion of the propellant charge when the projectile is fired.

In this arrangement the combustible adhesive material retains the firing pin in its safe position for a pre-determined period once the projectile has been fired. This prevents any shear forces being generated between the firing pin and the safety pin as the projectile decelerates on hitting still air. In this way ejection of the safety pin occurs immediately the projectile leaves the muzzle of the small arm. The time taken for the combustible adhesive material to release the firing pin and thus arm the projectile is determined by the characteristics of the combustible adhesive material.

A problem with this arrangement is that the combustible adhesive material may deteriorate and become unstable if stored for a prolonged period, particularly if the adhesive is in any way defective. This is a major drawback if a long shelf life is required as is usual for ammunition.

A further problem associated with this arrangement is that manufacturing constraints can result in the combustible adhesive material being insufficiently reliable to ensure that any delay in arming equates to about 3 metres from the user when the projectile is fired.

It is known, e.g. from FR-A-0 424 890, U.S. Pat. Nos. 2,537,855 and 2,564,797, that wholly mechanical contrivances can be used to effect safety latching of firing pins in projectile fuses, and that a firing pins can be used, whilst so latched, to hold an initiator in a safe condition, against forces urging it into an armed condition. None of these prior specifications, however, envisages the provision of increased safety in handling and in use, by means of plural, independently active mechanical safety latches which are designed and configured to be triggered in response to different events in the firing process.

SUMMARY OF THE INVENTION

An object of the present invention is to provide a small arms projectile which has a safety means for retaining a firing pin in a safety position prior to firing and releasing the firing pin on application of acceleration forces consequent upon firing.

Another object of the present invention is to provide a small arms projectile which has at least two mechanically independent safety means for retaining a firing pin in a safety position prior to firing.

Another object of the present invention is to provide a small arms projectile which has a safety means for retaining a firing pin in a safety position prior to firing which operates to delay the arming of the projectile on firing in a more reliable manner than hitherto known safety means.

According to an aspect of the present invention there is provided a small arms projectile for a small arms weapon; the projectile comprising:

- a generally tubular casing having an axially movable firing pin;
- a compression spring providing a resilient force;
- a warhead having an explosive charge; and
- an initiator having safe and armed conditions and capable, when in its armed condition and when impacted with sufficient force by the firing pin, of detonating the explosive charge of said warhead;
- wherein the casing also contains safety release means for releasably restraining the firing pin, against resilient force which tends to move the firing pin away from the initiator, in a safety position whereby said initiator is held by engagement with the firing pin in its safe condition, against an arming force tending to urge the initiator towards the armed condition;
- wherein the safety release means comprise first and second mechanical means;
- wherein said first mechanical means includes at least one component constructed to be frangible in response to the forces experienced on firing of the projectile, the strength of the frangible element being sufficient to withstand acceleration forces up to 500 g; and wherein said second mechanical means includes at least one component disposed and configured so as to be ejected from the casing under the influence of said resilient force when the projectile leaves the weapon permitting said resilient force to move said firing pin away from said initiator to an extent allowing said initiator to be urged into its armed condition.

Accordingly, the initiator is movable between an unarmed position and a biased armed position, but is retained in the unarmed position by engagement with the firing pin in the safety position. In this way the initiator can not be armed until the firing pin is moved from the safety position and disengaged from the initiator.

It will be understood that the abbreviation "g" used herein represents the acceleration due to gravity. Typically a small arm projectile will experience an acceleration of between 10,000 g and 15,000 g when fired in the chamber of a small arms weapon. The safety release means retains the firing pin in the safety position on application of acceleration forces less than 500 g to prevent accidental arming of the projectile prior to firing. In this way the releasable safety means will protect the user if the projectile is accidentally dropped during handling since the acceleration forces applied to the projectile will generally be less than 500 g.

Moreover the firing pin is caused to be released from said safety position only when the projectile has been fired and only when both the first and second mechanical means have been caused, in a predetermined sequence, to no longer be effective. In this way if one of the mechanical means fails the other will prevent movement of the firing pin from the safety position. Since the safety release means has releasable means which are mechanical, restraint of the firing pin is improved and problems associated with chemical degradation are avoided. Furthermore, this can prevent the firing pin moving towards the initiator when the projectile has been fired and is still in the chamber or bore of the small arm.

Preferably, said firing pin includes a separate axially movable base portion.

Conveniently, said frangible component comprises a shear pin positioned to support said base portion prior to firing of the projectile.

Thus, the first mechanical means is released from the firing pin by initial axial movement of the base portion in a direction away from the initiator. The acceleration forces applied to the base portion on firing can therefore be used to release the firing pin from the first mechanical means.

In another embodiment, said frangible component comprises a discoidal glass element disposed between said base portion and the casing to support said base portion prior to firing of the projectile.

Thus, the first mechanical means is released from the firing pin by initial axial movement of the base portion in a direction away from the initiator. The acceleration forces applied to the base portion on firing can therefore be used to release the firing pin from the first mechanical means.

Accordingly, the frangible component prevents release of the firing pin from the initiator until significant acceleration forces are applied to the base portion when the projectile is fired. The acceleration forces applied to the firing pin, and the base portion, on firing are considerable and in this way the frangible element can be made sufficiently strong to withstand shock loads due to mis-handling prior to firing.

Accordingly, the frangible element prevents release of the firing pin from the initiator until significant acceleration forces are applied to the base portion when the projectile is fired. The acceleration forces applied to the firing pin, and the base portion, on firing are considerable and in this way the frangible element can be made sufficiently strong to withstand shock loads due to mis-handling prior to firing.

Moreover, the frangible element can be readily fabricated and its breaking strength reliably controlled during manufacture.

It is preferred that the initiator is urged to move from its safe condition to its armed condition by rotating about an axis perpendicular to the axis of said casing.

Consequently, the initiator can only rotate to the biased armed position once the firing pin has disengaged.

In another embodiment, the resilient force applied to the firing pin is provided by a compression spring having sufficient stiffness to prevent the firing pin moving into the initiator due to deceleration experienced by the projectile as it leaves the muzzle of a small arm.

Since the firing pin is biased in an axial direction away from the initiator, this can prevent movement of the firing pin towards the initiator immediately the projectile exits the muzzle of the small arm. In this case, the firing pin strikes the initiator only when the projectile impacts the target.

Conveniently, said second mechanical means includes at least one spring biased safety pin.

Thus, the safety pin can be radially restrained in a cartridge from which the projectile is fired. For example, the safety pin is radially restrained by fins which are in turn radially restrained by the internal surface of the bore of the weapon from which it is fired and is released on exit from the muzzle. The projectile is thus armed either immediately on exit or within a short distance after exiting the muzzle of the shotgun.

In preferred embodiments, two spring biased safety pins are provided for release in opposite radial directions. This avoids any imbalance of the projectile once it has been fired.

Preferably, said casing supports a plurality of stabilising fins constrained to lie against the casing prior to firing of the projectile, but capable of deployment when the projectile leaves the weapon; and wherein at least one of said fins prevents ejection of the ejectable component of said second mechanical means until said deployment occurs; the deployment being assisted by motion of said firing pin under said resilient force.

In a particular embodiment, said firing pin is provided with a stabilising disc having a frusto-conical side portion disposed in contact with the ejectable component of said second mechanical means.

Conveniently, said initiator is constructed to generate, when in its armed condition, an initiating explosive charge in response to impact thereon of said firing pin and comprises means for causing said initiating explosive charge to conform to a predetermined shape about an initiator axis and wherein said initiator axis is misaligned with the axis of motion of said firing pin when held in its safe condition.

In a particular case, when the axis of said initiator is misaligned with the axis of motion of said firing pin, shielding means is interposed between the initiating charge and that of said warhead.

In a particular embodiment, said initiating explosive charge is contained in a cup-like structure and said shield comprises a portion of said structure.

BRIEF DESCRIPTION OF THE FIGURES

The invention will now be described, by way of illustration only, with reference to the accompanying drawings in which.

DETAILED DESCRIPTION

Figure 1:
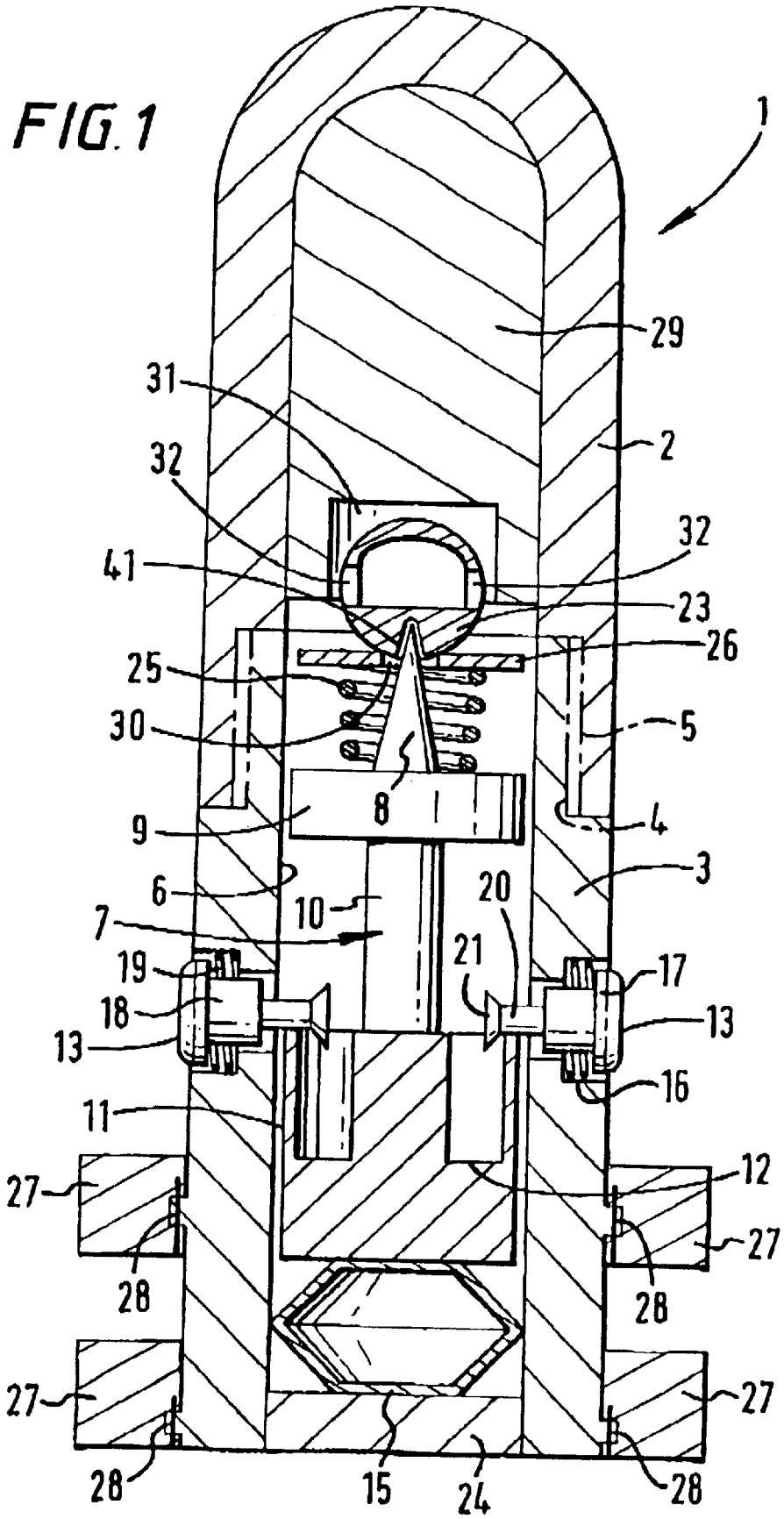
FIG. 1 is a vertical cross-sectional view of a projectile of one arrangement removed from a 3" (7.56 cm) 12 gauge cartridge, the projectile arrangement not embodying the present invention.

In all Figures, similar components of the small arm projectiles bear the same reference numerals.

With reference to FIG. 1, the projectile (1) is formed with a hollow warhead (2) and a hollow casing (3). The projectile has a generally cylindrical configuration about a central axis and is formed in this instance of aluminium castings. The warhead (2) and the casing (3) are separately formed castings provided with interlocking means in the form of an externally threaded portion (4) on the casing and an internally threaded portion (5) on the warhead. The warhead and casing are joined together immediately prior to assembly with a 12-bore cartridge.

The casing (3) is provided with an axial bore (6) which accommodates an axially movable cylindrical firing pin (7). The firing pin (7) is provided at its operative end nearest the warhead (2) with a conical needle portion (8) for contacting an explosive charge initiator (23) which is located in the warhead. The firing pin(7) also includes a stabilising disc portion (9) adjacent the needle portion, a reduced diameter shaft portion (10) adjacent the stabilising disc and a base portion (11). The stabilising disc (9) and base portion (11) have an external diameter which is substantially the same as the internal diameter of the axial bore (6). The base portion (11) includes an annular recess (12) on its side adjacent the reduced shaft portion (10).

In the drawing the firing pin (7) is shown in its safety position. The firing pin (7) is retained in this position by a safety release means which includes a primary mechanical releasable restraining means in the form of two diametrically opposite spring biased safety pins (13), and a secondary releasable mechanical restraining means in the form of a hollow frangible disc element (15).

The safety pins (13) are each located in a stepped throughbore (16) in the casing (3) The throughbores (16) halve an axis which is perpendicular to the axis of the casing (3). The safety pins (13) include a pin cap portion (17) and a shaft portion (18) which locates in the reduced diameter portion of the stepped throughbore (16). The shaft portion (18) of the safety pin has an external diameter which is substantially the same as the internal diameter of the reduced diameter portion of the throughbore. A compression spring (19) is provided in the larger diameter portion of the stepped throughbore (16) and bears upon the pin cap portion (17) to bias the safety pin (13) radially outwards. The safety pins (13) are held in the throughbore by engagement with the firing pin (7). At their remote ends the safety pins each include a reduced diameter portion (20) adjacent the shaft portion (18) and a outwardly splayed conical portion (21) which defines a detent. The reduced diameter portion (20) extends from the stepped throughbore and engages the forward axial face (22) of the base portion (11). The outwardly splayed conical portion (21) is partly located in the annular recess (12) and prevents axial movement of the firing pin (7) in the direction of the initiator (23).

By virtue of the fact that the safety pins (13) are retained by the firing pin (7) assembly is simplified considerably since it is no longer necessary to manually retain the safety pins (13) in their pre-expanded condition prior to locating the same in a cartridge for use.

The hollow frangible disc element (15) is positioned between the base portion (11) of the firing pin (7) and an annular back plate (24) which is attached to the casing (3). The strength of the frangible element is such that it prevents axial movement of the firing pin in a direction away from the initiator prior to firing and is crushed by axial movement of the firing pin in said axial direction on firing. In this respect the frangible element can withstand acceleration forces applied to the firing pin up to 5000 g.

A compression spring (25) is disposed around the conical portion (8) of the firing pin (7). The compression spring is retained by engagement with the stabilising disc portion (9) and an annular retaining plate (26) which is secured to the interior surface of the casing (3). The annular retaining plate (26) includes a central aperture (30) for receiving the conical portion (8). In the safety position shown the compression spring does not apply a significant load to the safety pin.

Located at the remote end of the casing (3) and about the external periphery thereof are four fins (27) which in use extend radially outwardly from the body of the casing (3). The fins (27) are of an accurate configuration such that in their folded-down position within the cartridge or barrel for example they will lie over the external periphery of the casing. To this end the fins (27) are hinged at (28), the axis of the hinge being slightly angled to the longitudinal axis of the projectile such that air pressure will cause the fins (27) to open and to spin the projectile when it has exited from the muzzle of the weapon. The fins (27) may be formed of a resilient material such as copper, or may be moulded into their final form of plastics or a mouldable metal such as aluminium.

The warhead assembly (2) is formed of an aluminium casting of a generally cylindrical configuration and includes a domed forward end. The domed forward end conjoins the cylindrical portion which extends downwardly towards the casing (3). The hollow portion of the warhead (2) is provided with an explosive (29), for example A5. The block of explosive (29) is in this particular arrangement, provided with a central bore (31) for the accommodation of an initiator (23) which in this particular instance defines part of a shutter mechanism. The initiator (23) is rotatably mounted on an axis perpendicular to the axis of the warhead (2) for movement between the angular position shown and a spring biased position 90 degrees apart. The initiator (23) is provided with a wedge shape slot (41) which engages the tip of the conical portion (8) when the firing pin is in the safety position. In this way the firing pin (7) retains the initiator (23) in the unarmed angular position shown. Spring biassing means (not shown) are provided for rotating the initiator

(23) by 90 degrees to an armed postion when the firing pin is moved relatively rearwardly. The initiator (23) is further provided with apertures (32) for receiving the tip of the conical portion (8) when rotated to the armed position.

Pre-moulded fragmentation portions (not shown) may also be formed on the internal or external faces of the warhead (2). In an alternative the warhead (2) may be formed of a hard epoxy resin into which a plurality of ball bearings have been exposed. The advantage of this latter construction is that the weight of the warhead (2) can be carefully adjusted by means of the utilisation of the correct weight and number of ball bearings. Further of course the point of balance of the projectile assembly can be altered by placing the ball bearings at various positions in varying numbers within the body of the material forming the warhead (2).

In use the explosive charge which is moulded to a predetermined shape is interfitted in the warhead (2) and the initiator (23) positioned therein. The casing (3) is assembled by positioning the frangible disc element (15) at the base of the bore (6) of the casing (3) once the firing pin (4) is introduced into the bore (6). The safety pins (13) are then introduced to the bore (6) and pressed home. With the cap portion (17) of the safety pins (13) retained in its pressed-in condition the firing pin (7) is then in retained in its safety position and the casing (3) and the warhead (2) may be then screwed together. If in this position the projectile is accidentally dropped even with the cartridge casing removed the concussion will not release the firing pin (7) because the safety pins (13) are inter-engaged therewith and the frangible disc element (15) is sufficiently strong not to break. Subsequently the fins (27) are positioned in their radially inward positions and the device is slipped into a standard 12-bore cartridge so as to fit on top of the wadding immediately over the propellant charge.

The cartridge may then be positioned in a standard shotgun with a cylindrical barrel and fired in a normal way. On firing the projectile (1) leaves the cartridge (not shown) and travels along the smooth bore barrel. The acceleration force applied to projectile in the barrel is typically in the range 10000 g to 15000 g. The acceleration force of the firing pin (7) causes the firing pin (7) to crush the frangible disc element (15). This allows the firing pin to move in an axial direction away from the initiator (23). The initiator (23) is thereby released from its unarmed position and rotates about its axis through 90 degrees to its armed position. As the firing pin moves rearwards away from the initiator (23) the safety pins (13) become dis-engaged from the annular recess (12). On exit from the barrel the restraint from the internal wall of the bore is removed and the safety pins (13) are immediately ejected radially outwards.

On exiting the barrel the projectile decelerates since the pressure of the propellant gases in the barrel no longer act upon it. The deceleration of the projectile urges the firing pin (7) towards the initiator (23). Contact between the firing pin (7) and the initiator (23) is avoided at this stage by the forward motion of the firing pin being countered by the restraining force applied by the compression spring (25) When the projectile (1) impacts the target, the deceleration forces upon it are very much greater and the associated force acting on the firing pin (7) overcomes the restraining force of the compression spring (25) and the tip of the firing pin (7) enters the aperture (32) of the initiator, thereby causing the charge to explode.

Figure 2:
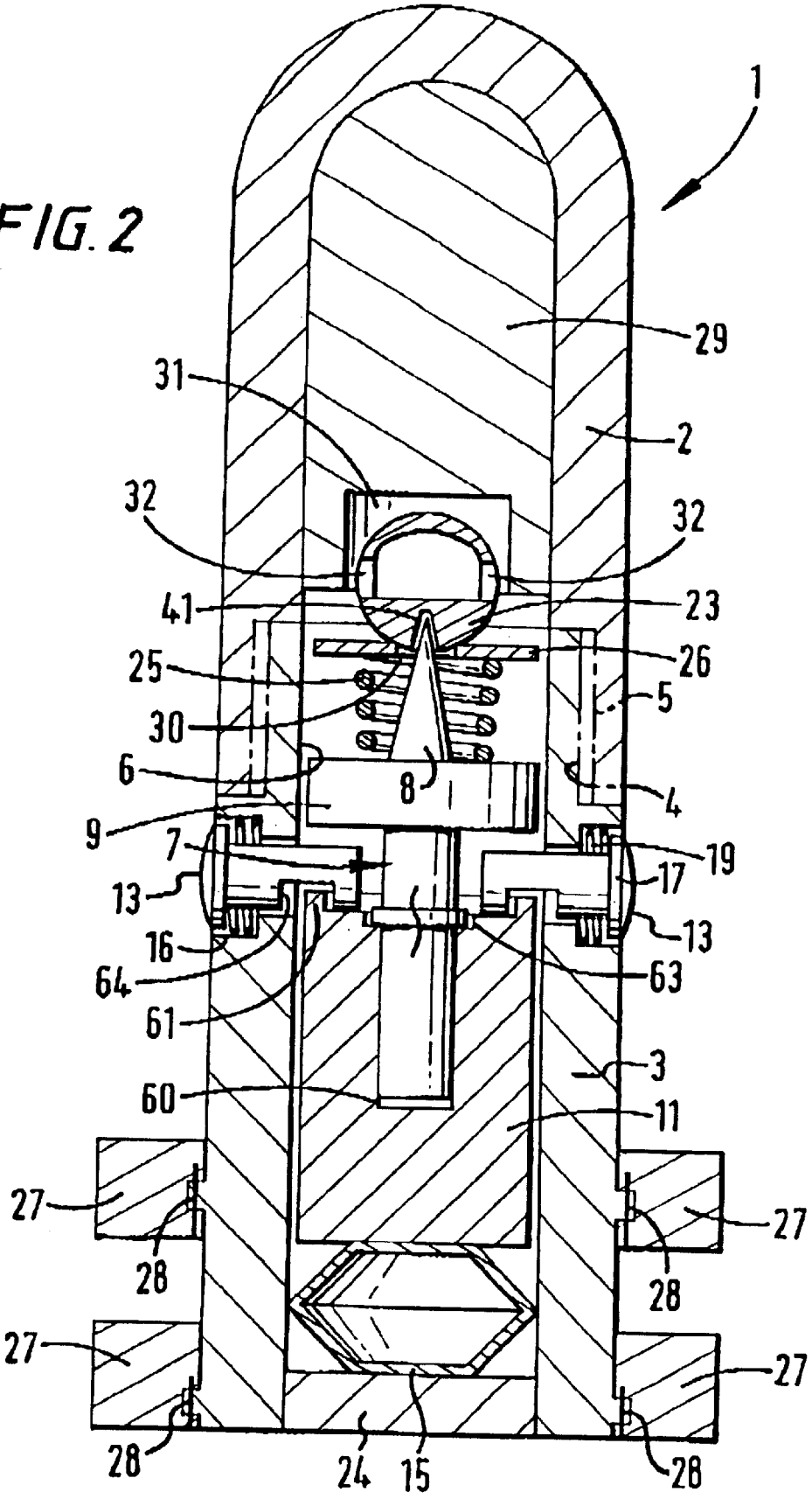
FIG. 2 is a cross-sectional view similar to FIG. 1 and shows another projectile arrangement not embodying the present invention.

With reference now to FIG. 2, the projectile (1) is substantially the same as the projectile of FIG. 1. The projectile of FIG. 2 differs from that of FIG. 1 in the sense that the firing pin (7) includes two separate components. The conical tip portion (8), the stabilising disc (9) and the reduced diameter shaft portion (10) are formed as one component, and the base portion (11) is formed as a separate component. The base portion (11) is provided with a central blind bore (60) and an annular flange (61) at its outer radial periphery on its forward axial face. The reduced diameter shaft portion (10) is located in the blind bore (60) at its end furthest from the tip portion (8). The reduced diameter portion has an external diameter substantially the same as the internal diameter of the blind bore (60) and includes a shoulder positioned part way along its length which is urged into engagement with a stepped annular recess (63) at the opening of the blind bore (61) by the compression spring (25). The safety pins (13) have a constant diameter shaft portion (18) which includes a slot (64). The slot (64) provides a detent which engages the annular flange (61) to prevent axial movement of the firing pin(7) in the direction of the initiator (23). In this respect it will be understood that the slot (64) and annular flange (61) replace the reduced diameter portion (20) and outwardly splayed conical portion (21) of the safety pins (13) and the annular recess (12) of the projectile of FIG. 1.

The projectile of FIG. 2 is fired in an identical manner to the projectile of FIG. 1. On firing the Acceleration force applied to the base portion (11) causes the base portion (11) to crush the frangible disc element (15). This allows the base portion (11) to move in the axial direction away from the initiator (23) relative to the shaft portion (10). As the base portion (11) moves rearwards away from the initiator (23) the safety pins (13) become disengaged from the annular flange (61). Axial movement of the shaft portion (10) in the direction away from the initiator is prevented by engagement of the safety pins (13) with the disc portion (9) The initiator (23) is thereby held in its unarmed position by engagement of the tip portion (8) and the V-groove (41). On exit from the barrel the safety pins eject radially outwards and the biassing force of the compression spring (25) urges the shaft portion (10) towards the base portion (11) in the axial direction away from the initiator (23). This causes the initiator (23) to be released from its unarmed position. The initiator (23) then rotates through 90 degrees to its armed position to arm the projectile.

Figure 3:
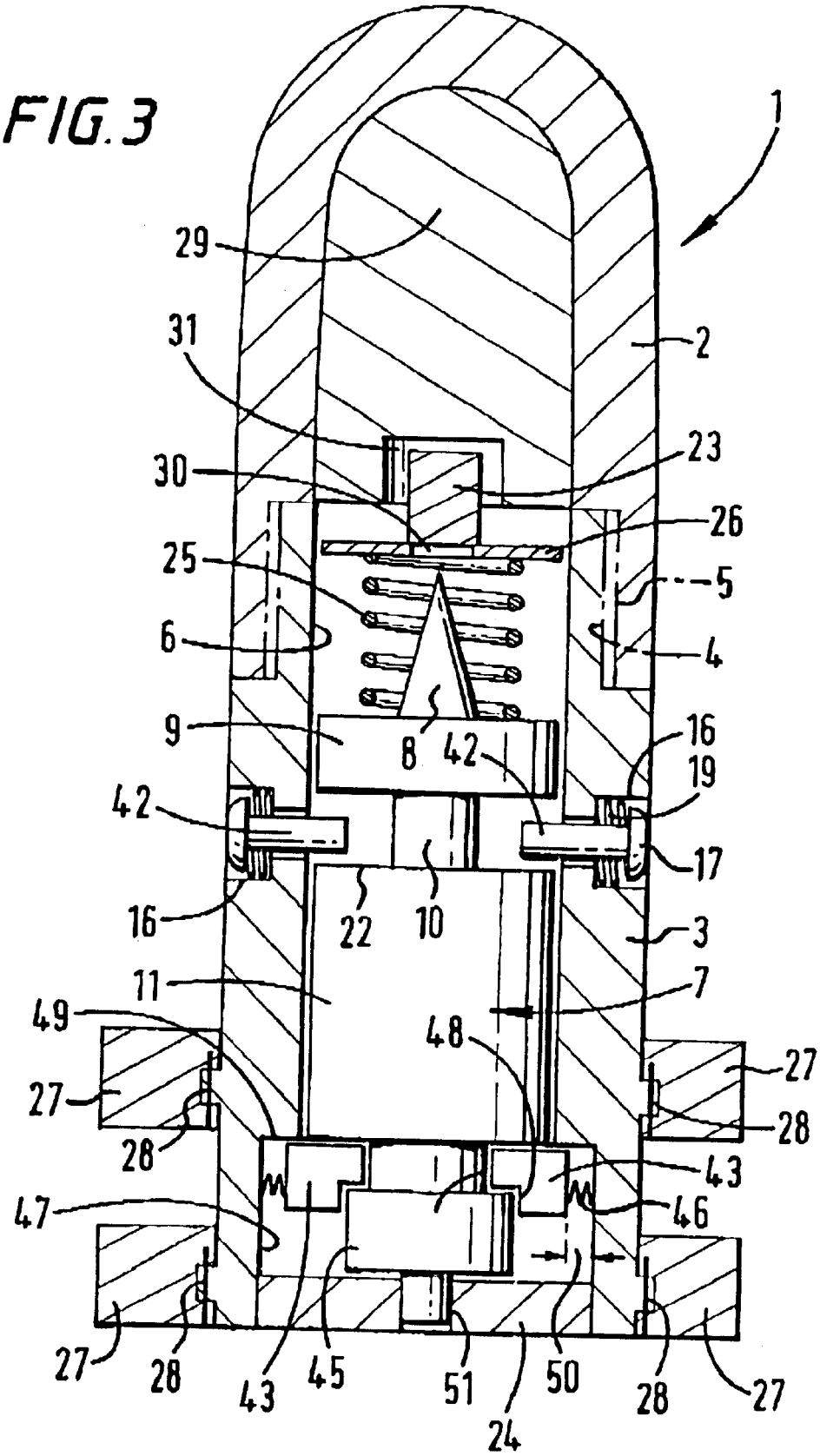
FIG. 3 is a cross-sectional view similar to FIG. 1 and shows yet another projectile arrangement not embodying the present invention.

With reference now to FIG. 3, the projectile (1) is substantially the same as the projectile of FIG. 1. The projectile of FIG. 3 is different from that of FIG. 1 in tie sense that the safety pins (13) have a constant diameter shaft portion (42) which extends from the cap portion (17). In FIG. 3 the safety pins (13) are radially restrained in the throughbores (16) by the interfitting cartridge. In the safety position shown, the safety pins (13) can engage the forward facing axial side (22) of the of the base portion (11) to prevent axial movement of the firing pin (7) in the direction of the initiator (23), and can also engage the opposing axial side of the stabilising disc (9) to prevent axial movement of the firing pin (7) in the direction away from the initiator.

The secondary mechanical releasable restraining means is provided by a plurality of circumferentially spaced radially movable elements (43). The elements (43) have a generally L-shaped cross-section and are interfitted in an annular groove (44) formed in a reduced diameter portion (45) of the firing pin (7) adjacent the base portion (11). The elements (43) are biased radially inwards into the annular groove (44) by spring biassing means (46) between the elements (43) and the casing (3). The elements (43) are accommodated in an annular recess (47) formed in the bore (6) at the end of the casing remote from the warhead (2). The annular recess (47) defines a stepped axial surface (49) in the bore (6). The radial dimension of the elements (43) is such that in the biased position shown the elements (43) extend radially outwards of the annular recess (44) and part way along the axial surface (48) into the annular recess (47). In this position the elements (43) define a radial gap (50) between the casing and their radially outer ends. Also in this position the elements (43) prevent axial movement of the firing pin (7) in the direction towards the initiator (23) by engagement with the stepped axial surface (49). The radial dimension of the gap (50) is marginally greater than that of the annular recess (45). The firing pin (7) is axially aligned in the bore (6) by location of its end furthest from the conical portion (8) in an aperture (51) provided in the end plate (24).

The initiator (23) is non-movably retained in the explosive (29) by the annular plate (26).

On firing the projectile (1) leaves the cartridge (not shown) and travels along the smooth bore barrel. On exit from the barrel the restraint of the internal walls of the bore is removed and the safety pins (13) are immediately ejected. Movement of the firing pin (7) towards the initiator (23) is then prevented by engagement of the elements (43) and the axial surface (49) only. As the projectile exits from the barrel the fins (27) deploy and cause the projectile to rotate about its axis. At a predetermined point the rotation of the projectile generates sufficient centrifugal force on the elements (43) to force them radially outwards against the biassing force of the spring biassing means (46). When the elements (43) engage the annular recess (47) they disengage from the annular recess (45) and thereby release the firing pin(7). This will generally occur 0.3 seconds after exiting the barrel resulting in a delay arming of the projectile equating to about 30 yards down range which is just far enough to ensure the safety for the user. Once the projectile is armed the tip of the firing pin (7) can enter the initiator on impact with the target being engaged.

The projectile of FIG. 3 therefore provides a projectile for a smooth bore weapon with a novel delay arming device, and a novel arming device per se.

Figure 4:
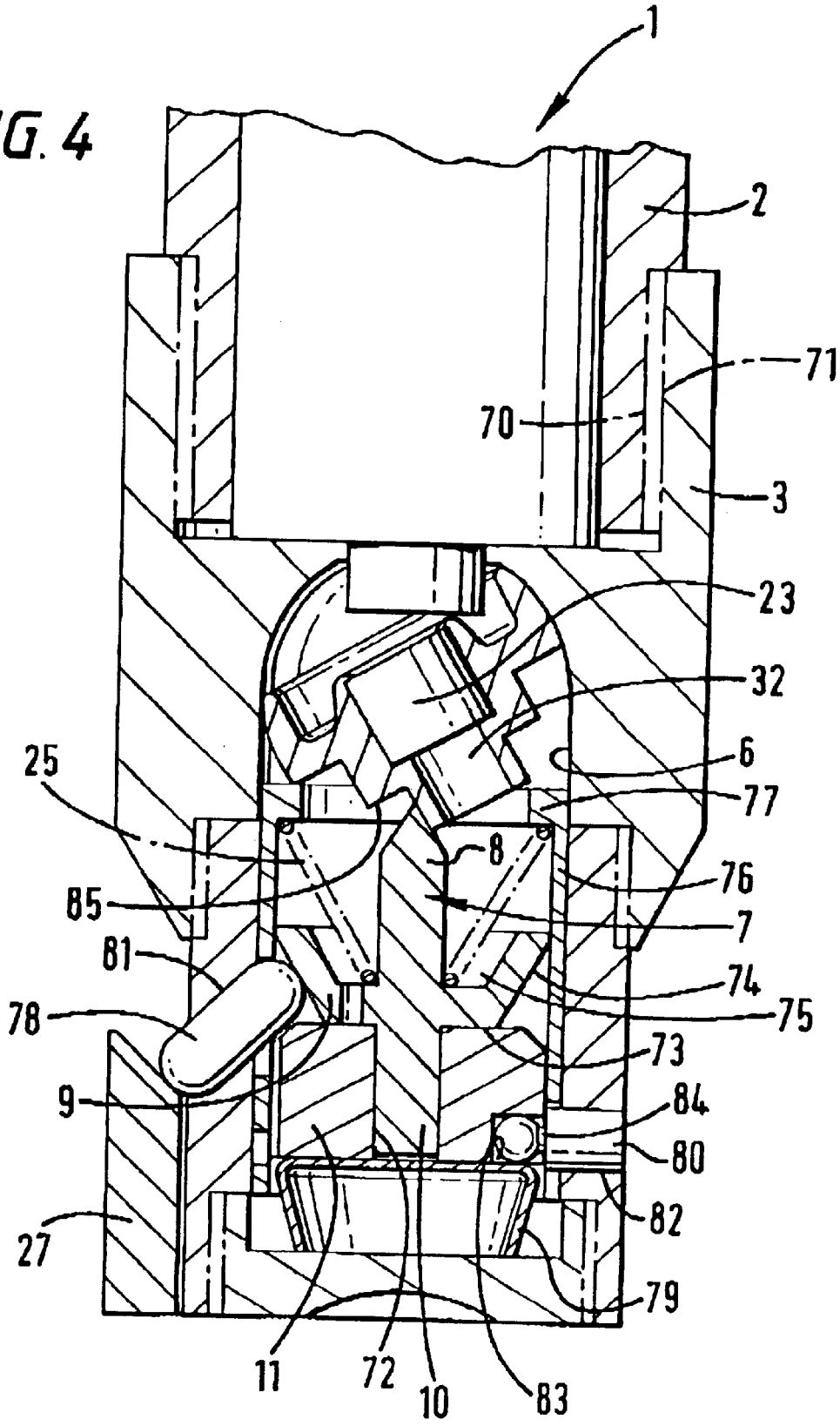
FIG. 4 is a cross-sectional view similar to FIG. 1 and shows a projectile according to a first embodiment of the present invention.

Referring now to the invention, FIG. 4 shows a projectile (1) according to a first embodiment of the present invention. The projection (1) of FIG. 4 is formed in a similar way to the projectile arrangements of FIGS. 1 to 3 in that it has a hollow warhead (2) and a hollow casing (3). In the drawing of FIG. 4 the detail of the warhead (2) has been omitted for clarity. The warhead (2) and casing (3) are separately formed castings with interlocking means in the form of an externally threaded portion (70) on the warhead (2) and an internally threaded portion (71) on the casing (3).

The projectile of FIG. 4 is provided with a two piece firing pin (7). The firing pin (7) of the projectile of FIG. 4 is similar to the firing pin (7) of the projectile of FIG. 2 in the sense that the conical tip portion (8), the stabilising disc (9) and the shaft (10) are formed as one component, and the base portion (11) as a separate component. The shaft portion (10) is located in a central throughbore (72) in the base portion (11). The stabilising disc comprises a flat base (73) and a frusto conical side portion (74) which together provide a recess (75) on the initiator side of the stabilising disc. A cylindrical sleeve (76) is located in the bore (6) of the casing (3) adjacent the firing pin (7). An annular shoulder (77) is provided at the end of the sleeve (76) nearest the firing pin tip (8) to receive one end of a compression spring (25). The other end of the compression spring is located in the recess (75) to urge the flat base (73) of the stabilising disc into engagement with the base (11).

The firing pin (7) is retained in the safety position shown by a primary releasable mechanical restraining means comprising at least one spring biased safety pin (78) in the form of a frangible disc element (79). In this embodiment the safety release means additionally comprises a tertiary mechanical releasable restraining means in the form of at least one shear pin (80) disposed in a recess (83) in the base (11).

The safety pin (78) is located in an inclined throughbore (81) in the side of the casing (3). At one end the safety pin (78) engages the frusto-conical side portion (74) of the stabilising disc (9). The safety pin (78) is spring loaded in a radially outwards direction by the compression spring (25) acting on the disc (9) and are restrained within its throughbore (31) by a fin (27) when in its folded-down condition as shown.

The shear pin (80) is located in a throughbore (82) in the side of the casing (3) and extends within a recess (83) provided in the base (11). The shear pin (80) is provided with a reduced diameter frangible portion (84) which is positioned to correspond to the position between the recess (83) and the throughbore (82).

The spring biased initiator (23) is located within the bore (6) of the casing. The initiator (23) is provided with a stepped outer surface (85) which is engaged by the tip of the conical portion (8) when the firing pin is in the safety position. The initiator (23) is spring loaded to its armed postion which corresponds to the aperture (32) being aligned with the axis of the firing pin.

The projectile of FIG. 4 is fired in an identical manner to the projectiles of FIGS. 1 to 3. On firing, the acceleration force applied to the base portion (11) causes the base portion (11) to crush the frangible disc element (79) and the shear pin (80) to shear. This allows the base portion (11) to move in the axial direction away from the initiator (23) relative to the shaft portion (10). Axial movement of the shaft portion (10) in the direction away from the initiator is prevented by engagement of the safety pin (78) with the frusto-conical portion (74). The initiator (23) is thereby held in its unarmed position by engagement of the tip portion (8) with the stepped outer surface (85) when in the barrel of the smooth bore weapon. On exit from the barrel the fins (27) deploy and the safety pin (78) ejects radially outwards and the biasing force of the compression spring (25) urges the shaft portion (10) towards the base portion (11) in the axial direction away from the initiator (23). This causes the initiator (23) to be released from its unarmed position. The initiator (23) then rotates through approximately 30 degrees to its armed position to arm the projectile.

FIG. 4 has been described as comprising a single safety pin (78) and a single shear pin (80). In another embodiment these are supplemented by a second safety pin (78) and shear pin (80) positioned diametrically opposite each other respectively.

The embodiment of the invention shown in FIG. 4 provides a highly significant improvement in the safety of projectiles of this kind, based upon the important fact that, until the initiator (23) is permitted to move into its armed position, there is neither a direct line of impingement of the pin (7) into the initiator nor a direct line of communication between the initiator and the explosive (29). This is used to further advantage in the embodiments of the invention illustrated 5(*a*), 5(*b*) and 6.

Figure 5A:
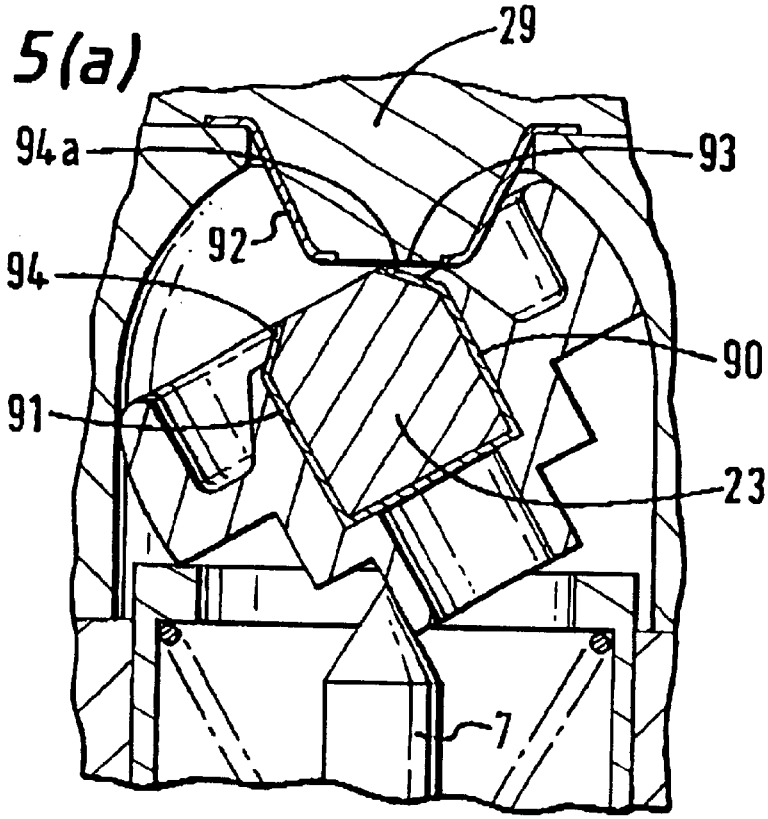
FIGS. 5(*a*) and 5(*b*) are partial cross-sectional views showing an alternative relationship between initiator and warhead components to that shown in the FIG. 4 in safe (but accidentally triggered) and armed conditions respectively.
Figure 5B:
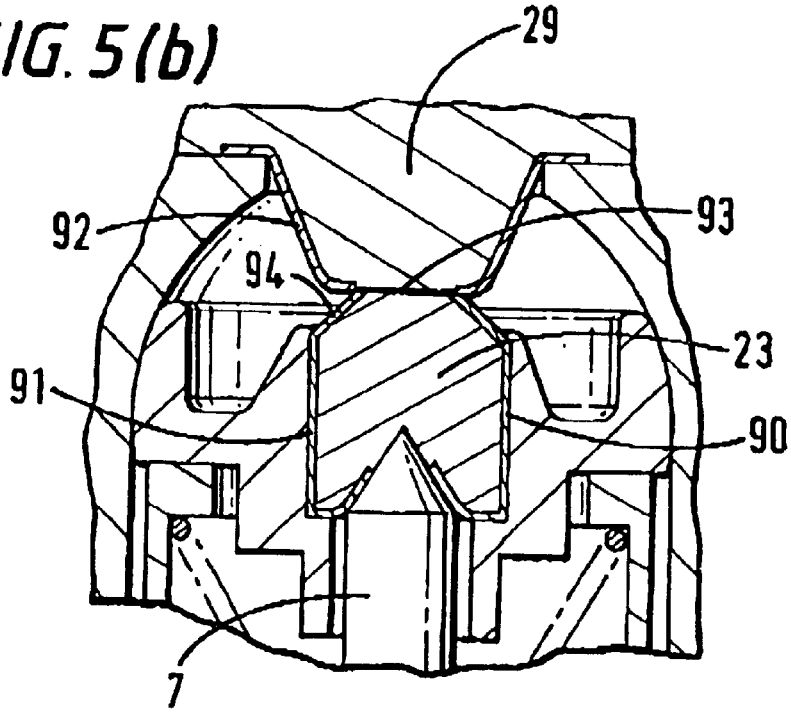

Referring now to FIG. 5(*a*), it can be seen that the initiator (23) is contained within a cup-like construction (90), made of aluminium, and preferably surrounded with titanium foil (91), or otherwise coated with or bearing a layer of titanium, of thickness in the order of 0.001 inch. The warhead's explosive charge (29) is contained behind a shield (92) which adopts a top-hat like shape towards the initiator (23) with a thinned central portion (93). The cup-like structure (90, 91) is formed with a lid part (94), which faces towards the shield (92) so that, in general, when the projectile is safe, the lid part (94) lies in front of and parallel to the thinned portion (93) of the shield (92) when the initiator (23) is not in line with the main charge. By this means, there is provided a shaping of the initiator's charge and a shielding of the main charge (29) whereby, in the event of an accidental triggering of the initiating charge by some external agency, as indicated by the fracture of the lid part (94), the energy of the charge does not directly impact the main charge (29), as it is skewed away from the direct "line of sight" thereto, and moreover the lid part (94) of the cup-like structure (90, 91) tends to be opened out, as shown at 94*a*, and thus provides a strengthened shield between the initiating charge and the main explosive charge (29) of the projectile.

FIG. 5(*b*) is identical to FIG. 5(*a*), except that it shows the armed condition, wherein the cup-like structure (90, 91) has been allowed to rotate so as to align the charge (23) with the thinned region (93) of the shield (92). In this condition, when the initiator charge is fired, as shown, the opened-out portions of the lid part (94) no longer overlie the thinned region (93) of the shield (92) and indeed assist in concentrating the initiator's charge into the main explosive charge (29) of the warhead; i.e. they provide a "fire channel" directing the initator's energy to the main charge.

Figure 6:
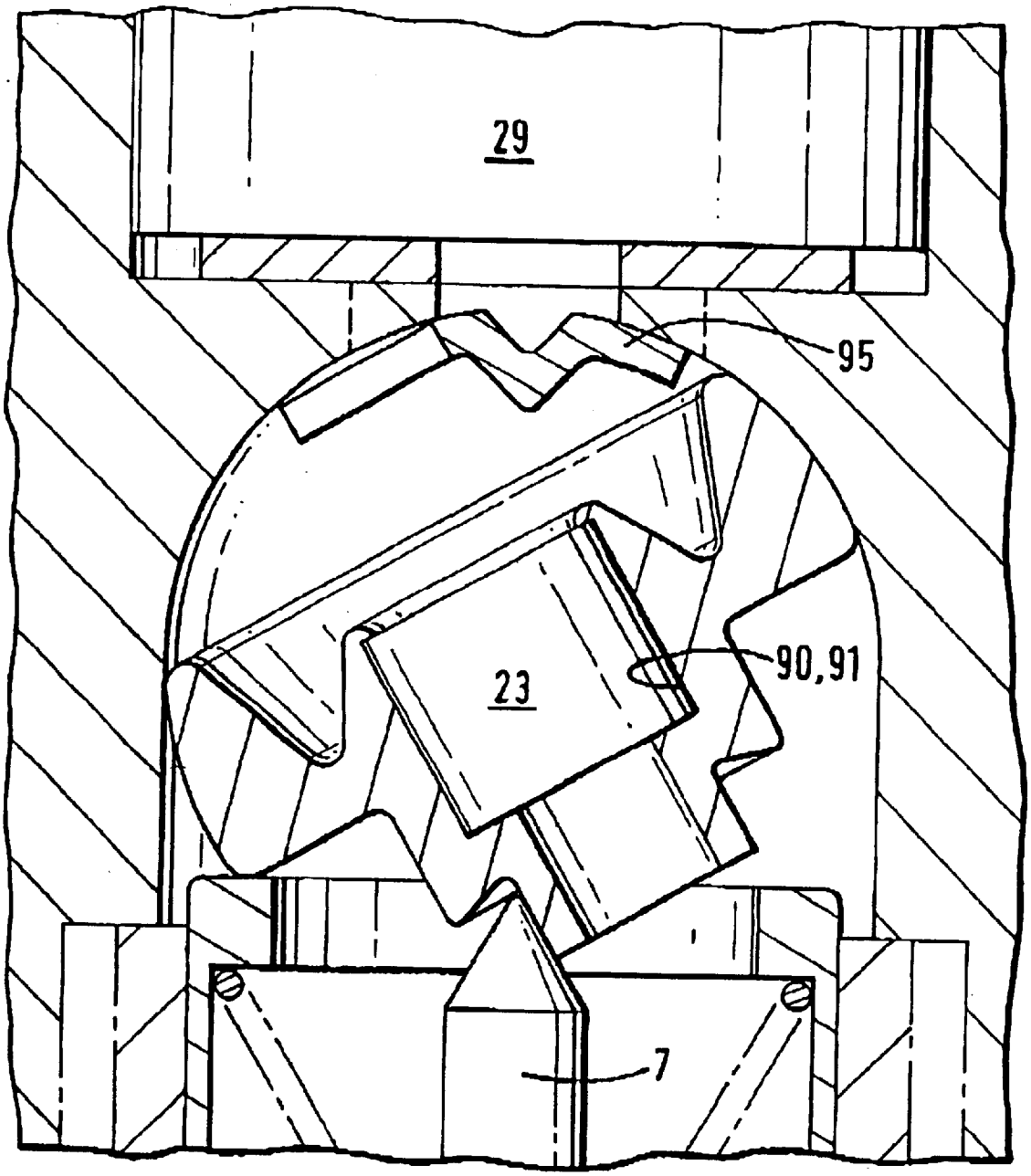
FIG. 6 is a cross-sectional view showing a further alternative relationship between the initiator and warhead components to that shown in FIG. 4.

In the embodiment of FIG. 6, the principal difference from that of FIG. 5 is that there is provided a shielding shutter (95) that is integral with, and thus rotates with, the initiator (23), thereby obviating the need for the lid part (94) to the cup-like structure (90, 91) which is otherwise as described in relation to FIG. 5. The shutter (95) is shaped, dimensioned and crafted of suitable material to resist or at least lessen the impact on the main explosive charge (29) of an accidental discharge of the initiator charge. In this respect, it can be made relatively bulky since, of course, it is automatically moved out of the line of action between the initiator (23) and the main explosive charge (29) of the projectile when the initiator rotates to its armed position.

The combination, as shown in FIGS. 5 and 6, of shaping, at least to an extent, the initiator's charge, skewing the shaped charge, with respect to the direct path to the main explosive charge, in an "unarmed" condition, and providing additional shielding along the direct path in the "unarmed" condition, provides a significant degree of additional safety against unwanted detonation of the main charge whilst not compromising the sensitivity of the warhead to detonation in the "armed" condition, when the initiator charge is rotated to align with the direct path to the main explosive charge.

It will be understood that FIGS. 4 to 6 illustrate particular embodiments of the invention only. In this respect, although the present invention is described with reference to fins it is appreciated that the invention also refers to projectiles not including fins.

What is claimed is:

1. A small arms projectile for a small arms weapon, the projectile comprising:

(a) a generally tubular casing having an axially movable firing pin;

(b) a compression spring providing a resilient force;

(c) a warhead having an explosive charge; and (d) an initiator having safe and armed conditions and capable, when in its armed condition and when impacted with sufficient force by said firing pin, of detonating the explosive charge of said warhead;

wherein the casing also contains safety release means for releasably restraining said firing pin, against said resilient force which tends to move said firing pin away from said initiator, in a safety position whereby said initiator is held, by engagement with said firing pin, in its safe condition, against an arming force tending to urge said initiator towards the armed condition;

wherein the safety release means comprises first and second mechanical means;

wherein said first mechanical means includes at least one component constructed to be frangible in response to the forces experienced on firing of the projectile, the strength of the frangible element being sufficient to withstand acceleration forces up to 500 g; and wherein said second mechanical means includes at least one component disposed and configured so as to be ejected from said casing under the influence of said resilient force when the projectile leaves the weapon permitting said resilient force to move said firing pin away from said initiator to an extent allowing said initiator to be urged into its armed condition.

2. A small arms projectile according to claim 1, wherein said firing pin includes a separate axially movable base portion.

3. A small arms projectile according to claim 2, wherein said frangible component comprises a shear pin positioned to support said base portion prior to firing of the projectile.

4. A small arms projectile according to claim 2, wherein said frangible component comprises a disc element disposed between said base portion and said casing to support said base portion prior to firing of the projectile.

5. A small arms projectile according to claim 2, wherein said initiator is urged to move from its safe condition to its armed condition by rotating about an axis perpendicular to the axis of said casing.

6. A small arms projectile according to claim 2, wherein the resilient force applied to said firing pin is provided by said compression spring which has sufficient stiffness to prevent said firing pin moving into said initiator due to deceleration experienced by the projectile as it leaves the muzzle of a small arms weapon.

7. A small arms projectile according to claim 2, wherein the ejectable component of said second mechanical means includes at least one spring-biased safety pin.

8. A small arms projectile according to claim 7, wherein two spring-biased safety pins are provided for release in opposite radial directions.

9. A small arms projectile according to claim 1, wherein said casing supports a plurality of stabilizing fins constrained to lie against said casing prior to firing of the projectile, but capable of deployment when the projectile leaves the weapon; and wherein at least one of said fins prevents ejection of the ejectable component of said second mechanical means until said deployment occurs, the ejection and the deployment being assisted by motion of said firing pin under said resilient force.

10. A small arms projectile according to claim 9, wherein said firing pin is provided with a stabilizing disc having a frusto-conical side portion disposed in contact with the ejectable component of said second mechanical means.

11. A small arms projectile according to claim 1, wherein said initiator is constructed to generate, when in its armed condition, an initiating explosive charge in response to impact thereon of said firing pin and comprises means for causing said initiating explosive charge to conform to a predetermined shape about an initiator axis, and wherein said initiator axis is misaligned with the axis of motion of said firing pin when held in its safe condition.

12. A small arms projectile according to claim 11, wherein, when the axis of said initiator is misaligned with the axis of motion of said firing pin, shielding means is interposed between the initiating charge and that of said warhead.

13. A small arms projectile according to claim 12, wherein said initiating explosive charge is contained in a cup-like structure and said shield comprises a portion of said structure.

* * * * *